US009951533B2

(12) United States Patent
Shaw

(10) Patent No.: US 9,951,533 B2
(45) Date of Patent: Apr. 24, 2018

(54) DRYWALL MUD DISPENSER CLOSURE SYSTEM

(71) Applicant: Todd Shaw, Dickens, IA (US)

(72) Inventor: Todd Shaw, Dickens, IA (US)

( * ) Notice: Subject to any disclaimer, the term of this patent is extended or adjusted under 35 U.S.C. 154(b) by 163 days.

(21) Appl. No.: 14/171,311

(22) Filed: Feb. 3, 2014

(65) Prior Publication Data

US 2015/0217325 A1 Aug. 6, 2015

(51) Int. Cl.
*E04F 21/10* (2006.01)

(52) U.S. Cl.
CPC ..... *E04F 21/10* (2013.01)

(58) Field of Classification Search
CPC combination set(s) only.
See application file for complete search history.

(56) References Cited

U.S. PATENT DOCUMENTS 251,525 A * 12/1881 Codd ..... B65D 51/243 215/226
493,701 A * 3/1893 Gillette ..... B65D 39/02 215/298
2,533,715 A 11/1946 Conklin et al.
2,906,421 A * 9/1959 Assen ..... B65D 41/18 215/321
3,349,975 A * 10/1967 Damron ..... B65D 41/02 215/317
3,363,762 A 1/1968 Ensign
3,441,162 A * 4/1969 Julius ..... B65D 41/18 215/305
4,114,654 A 9/1978 Richardson
4,178,966 A 12/1979 Savor et al.
4,646,816 A 3/1987 Rothstein
5,022,437 A 6/1991 Potz et al.
5,437,310 A 8/1995 Cunningham
6,170,530 B1 1/2001 Steblina
6,877,923 B2 * 4/2005 Grayden ..... B43M 11/06 401/193
7,317,065 B2 1/2008 Adelman
2002/0118547 A1 8/2002 Holthaus

* cited by examiner

*Primary Examiner* — David Walczak

(57) ABSTRACT

A drywall mud dispenser closure system includes a drywall mud applicator having an access opening therein. A closure assembly is removably positioned over the access opening and closes the access opening to inhibit air from entering the access opening.

5 Claims, 4 Drawing Sheets

DRYWALL MUD DISPENSER CLOSURE SYSTEM

BACKGROUND OF THE DISCLOSURE

Field of the Disclosure

The disclosure relates to covering devices for open housings having a fluidic medium therein and more particularly pertains to a new covering device for preventing mud from within a drywall mud joint dispenser housing from drying out.

SUMMARY OF THE DISCLOSURE

An embodiment of the disclosure meets the needs presented above by generally comprising a drywall mud applicator having an access opening therein. A closure assembly is removably positioned over the access opening and closes the access opening to inhibit air from entering the access opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
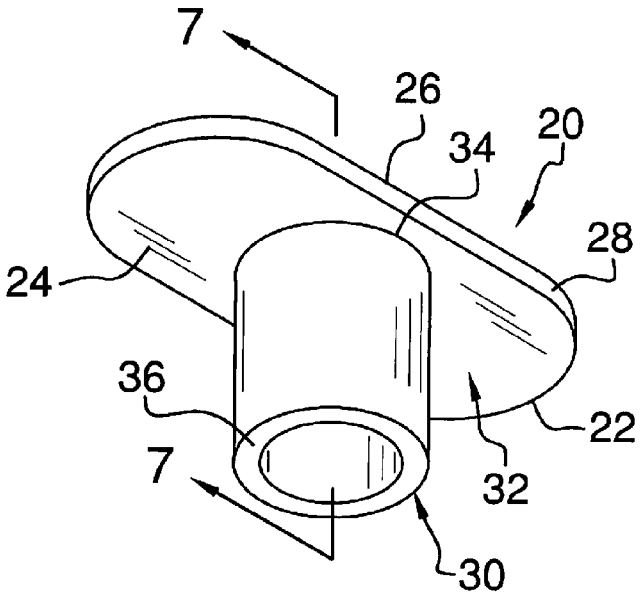
FIG. 1 is a side perspective view of a drywall mud dispenser closure system according to an embodiment of the disclosure.
Figure 7:
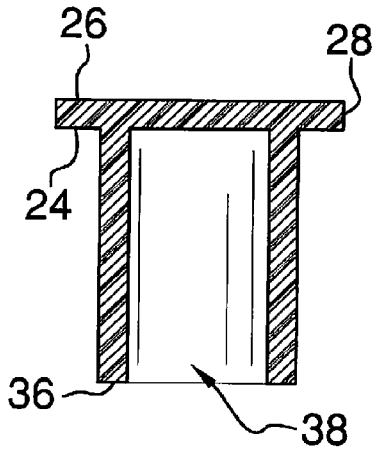
FIG. 7 is a cross-sectional view of an embodiment of the disclosure taken along line 7-7 of FIG. 1.

With reference now to the drawings, and in particular to FIGS. 1 through 7 thereof, a new covering device embodying the principles and concepts of an embodiment of the disclosure and generally designated by the reference numeral 10 will be described.

As best illustrated in FIGS. 1 through 7, the drywall mud dispenser closure system 10 generally comprises a drywall mud applicator 12, 13 having an access opening 14 therein. The term "drywall mud applicator" is conventional to include all forms of devices used for applying mud (drywall joint compound, adhesive filler, etc.) either directly to a wall surface alone or devices which apply mud and tape. The former devices may include those devices commonly known as flat or mud boxes 13, as is shown in U.S. Pat. No. 6,146,039, or drywall tape and mud dispensers 12 one of which being depicted in U.S. Pat. No. 7,568,513. These types of devices may include various access openings 14, or ports, either for filling with the mud material or for dispensing the mud material. In particular, drywall tape and mud dispenser 12 typically include a fill aperture to allow a person to pump the mud into the dispenser 12. This fill aperture 14 may include a conduit, or tube, for increasing the ease of fluidic attachment to a pump. Thus, the pump is typically placed in fluid communication with a container of mud, coupled to the conduit and then actuated to force mud into the dispenser 12. Flat boxes 13 include an access opening 14 which is defined as an elongated dispensing opening. The access opening 14 allows the flat box 13 to be moved across a surface while depositing a smooth, wide path of mud on the wall over joints. In each of these cases, as well as other attachments understood within the art of drywall joint covering, the access openings 14 unfortunately allow air into the applicator 12, 13 which can cause the mud to dry out. This may occur, for instance, during a construction worker break or at the end of the work day. When the mud dries out, it must be removed by laborious methods which may include partial disassembly of the drywall mud applicator 12, 13.

Figure 2:
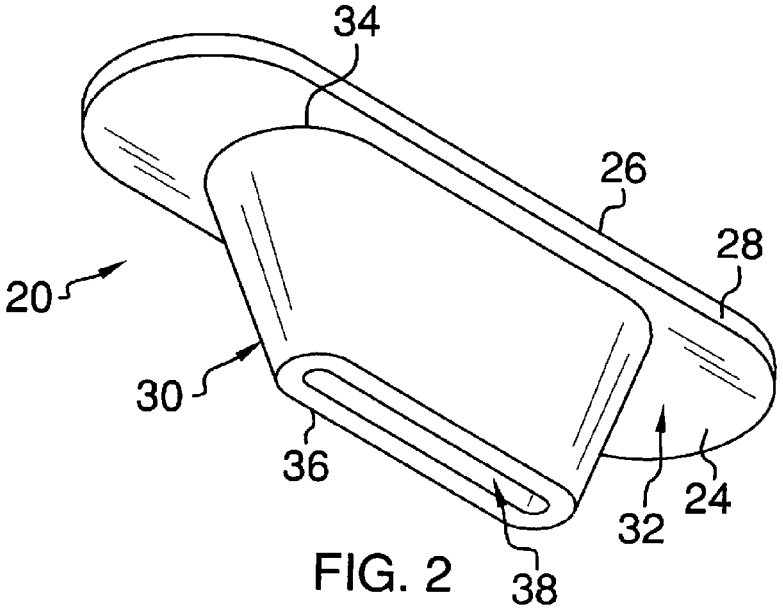
FIG. 2 is a side perspective view of an embodiment of the disclosure.
Figure 3:
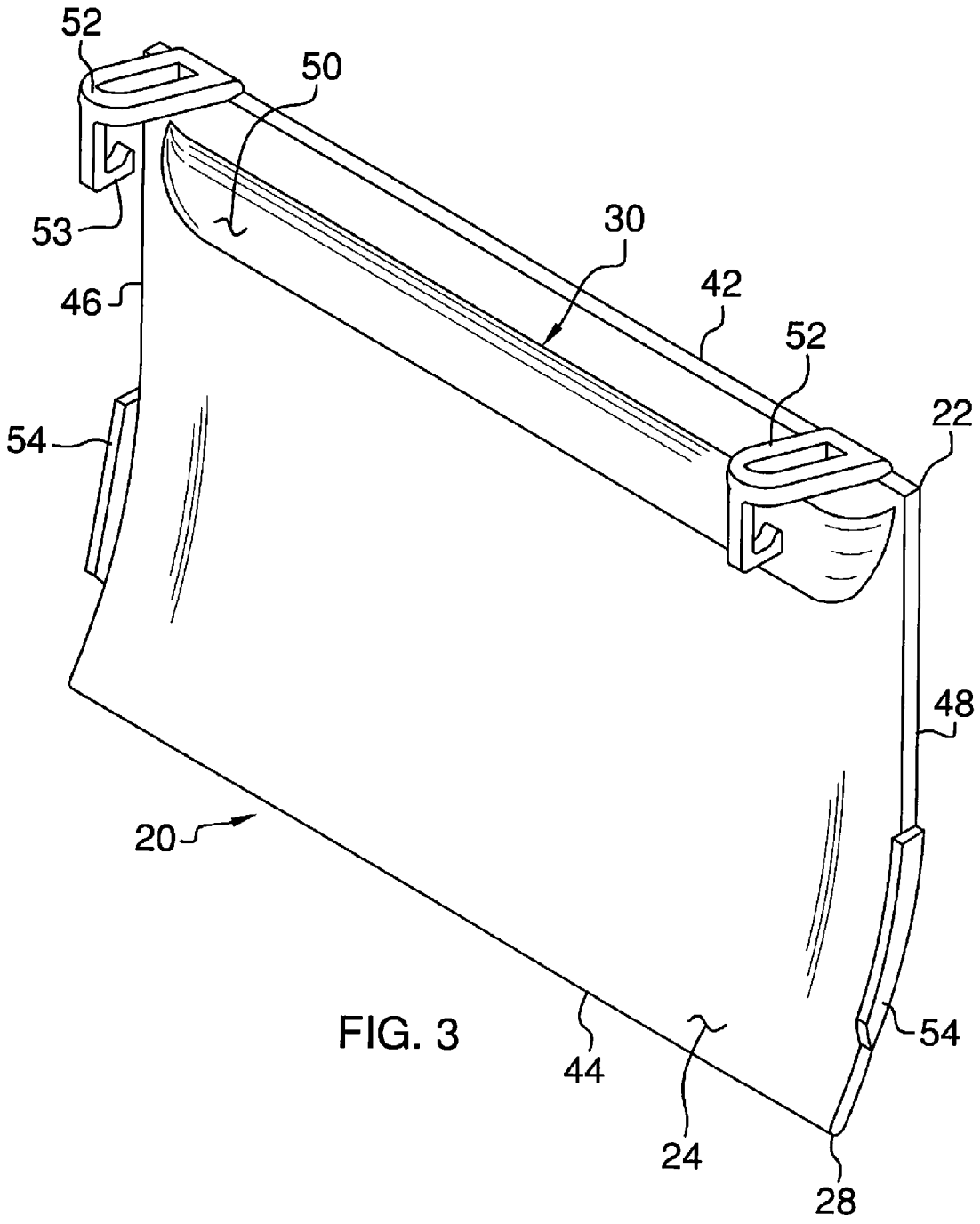
FIG. 3 is a front perspective view of an embodiment of the disclosure.
Figure 4:
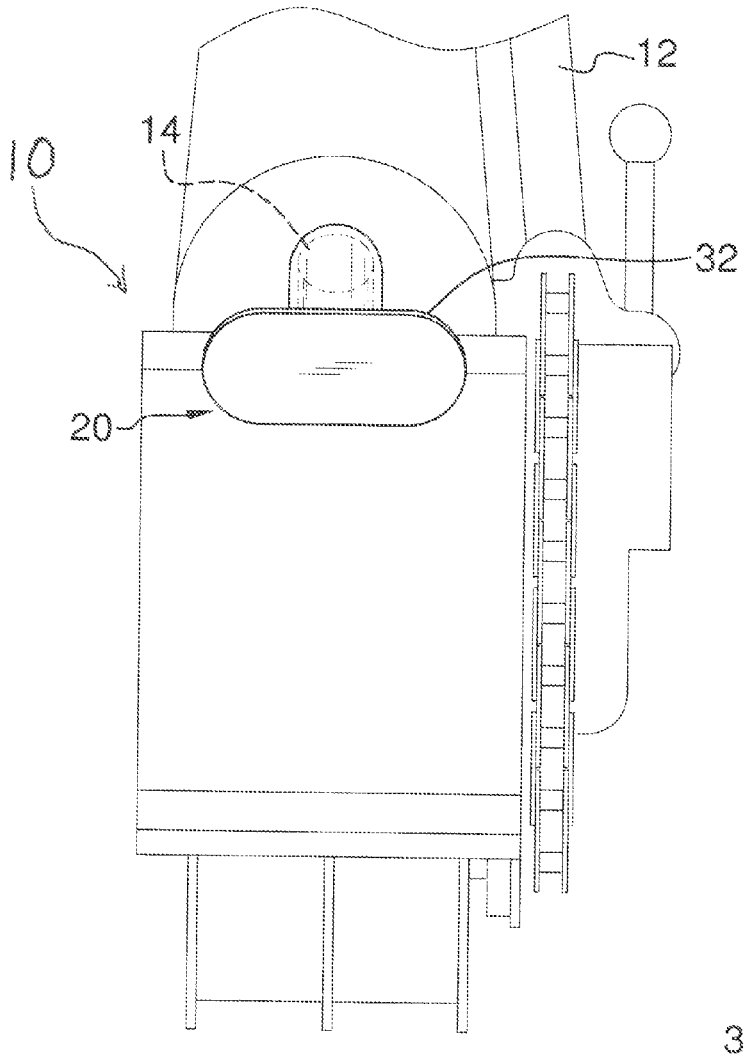
FIG. 4 is a rear perspective in-use view of an embodiment of the disclosure.

A closure assembly 20 is removably positioned over the access opening 14 and closes the access opening 14 to inhibit air from entering the access opening 14. In this manner the mud within the drywall mud applicator 12, 13 will not dry out. FIGS. 1, 2 and 3 each depict various closure assemblies 20. The closure assembly 20 includes a wall 22 having a front side 24, a back side 26 and a perimeter edge 28. An aperture cover 30 is attached to and extends away from the front side 24. The aperture cover 30 has a size and shape configured to cover the access opening 14 to prevent air from entering the access opening 14. Generally, the closure assembly 20 may be comprised of a rubber, plastic or metallic material though it may be beneficial to utilize a material which is resiliently stretchable such as an elastomer.

Figure 5:
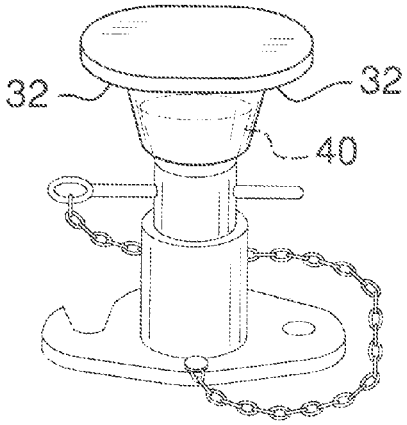
FIG. 5 is a side perspective in-use view of an embodiment of the disclosure.

The perimeter edge 28 extends outwardly away from the aperture cover 30 to define a flange 32 between the aperture cover 30 and the perimeter edge 28 of the wall 22. This area between the aperture cover 30 and the perimeter edge 28 forms a gripping area to facilitate gripping of the wall 22. The perimeter edge 28 may extend away from the flange in all directions with respect to the aperture cover 30. As shown in FIGS. 1, 2, 4, 5 and 7, the aperture cover 30 has a tubular shape having a proximal end 34 attached to the wall 22 and a distal end 36 spaced from the wall 22. The distal end 36 may have a well 38 extending therein configured for receiving the conduit, shown as attached to access opening 14 in FIG. 7, fluidly coupled to the access opening 14. More particularly, the embodiment shown in FIGS. 1 and 4 may include an aperture cover 30 having a cylindrical shape. Alternatively, as shown in FIGS. 2 and 5, the aperture cover 30 may have a frustum shape and narrows from the wall 22 to the distal end 36. Moreover, the aperture cover 30 may have a base abutting the wall 22 having a length dimension and a width dimension wherein the length dimension is greater than the width dimension. Such an aperture cover as shown in FIG. 5 would primarily be used for additional attachments such as a conventional box filler adapter 40. It should be noted, however, that the closure assembly 20 of FIG. 1 may be used to fit nozzles or conduits that might otherwise be used with the similar device of FIG. 2 since the material of the FIG. 1 device will be resiliently stretchable and therefore will conform to the box filler adapter 40 without requiring a particular shape to do so.

Figure 6:
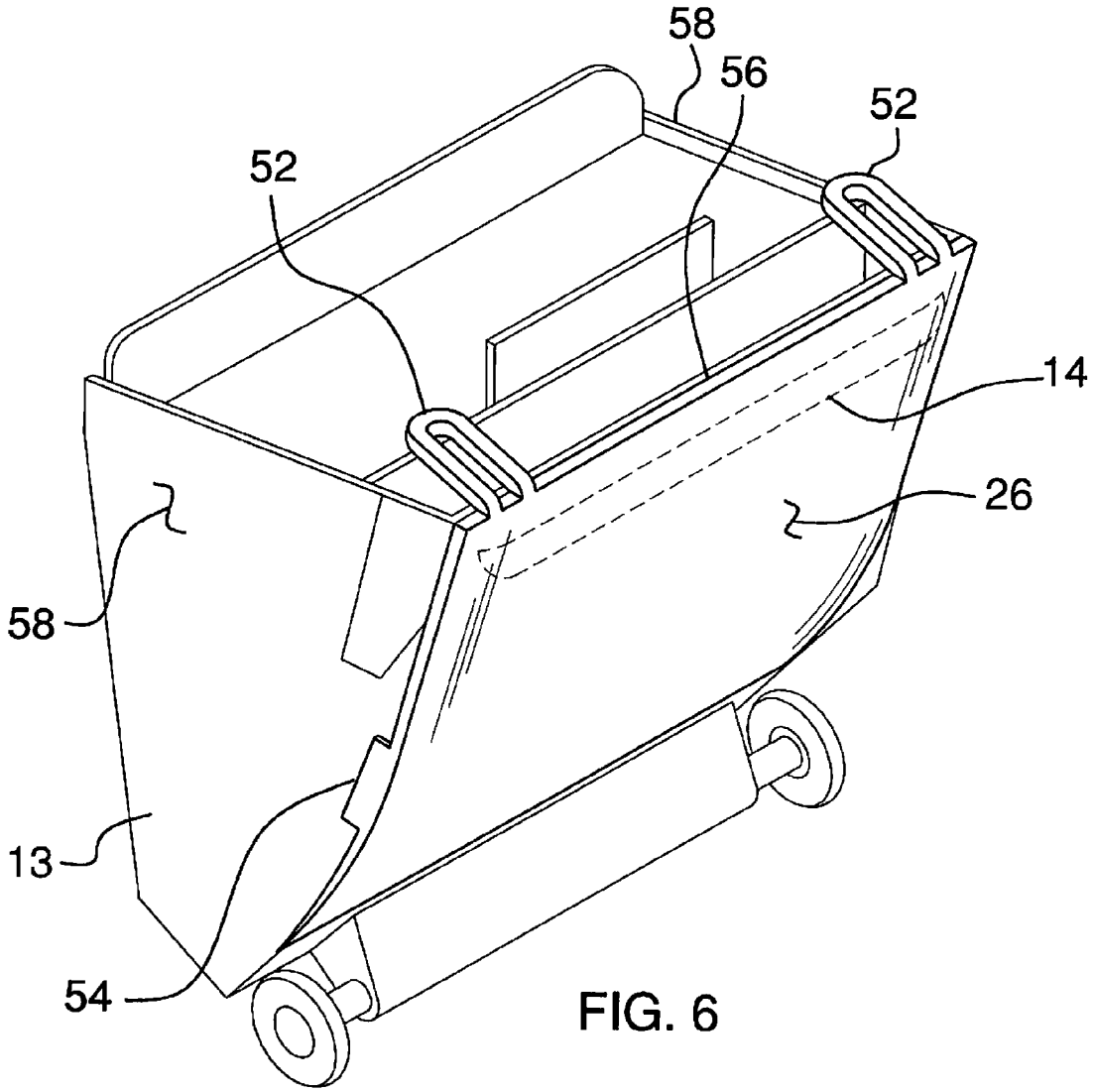
FIG. 6 is a rear perspective view of an embodiment of the disclosure.

In the embodiments of FIGS. 3 and 6, the wall 22 has a rectangular shape and includes an upper edge 42, a lower edge 44, a first side edge 46 and a second side edge 48. The aperture cover 30 of this embodiment is elongated and extends along a line oriented parallel to the upper edge 42. The aperture cover 30 is nearer to the upper edge 42 than the bottom edge 44 and is removably extendable in the access opening 14 of a drywall mud applicator 13 and more particularly the dispensing opening of a flat box. The aperture cover 30 may have a convexly arcuate surface 50 taken perpendicular to a longitudinal axis of the aperture cover 30. At least one coupler 52 is mounted on the wall 22 and releasably engages the drywall mud applicator 13, though more than one coupler 52 may be utilized. The couplers 52 may include hooks 53 that may engage lips commonly found along an edge 56 of the flat box or may simply be used to extend over the edge 56 of the flat box such that the aperture cover 30 is biased upwardly against an edge of the access opening 14 to help retain the wall 22 in abutment with the flat box. The couplers 52 and hooks 53 may comprise an elastomeric or similar material and be resiliently bendable. A pair of stops 54 may also be included. Each of the stops 54 is attached to the front side 24 of the wall 20, and may be positioned on the lateral edges of the wall 20, and are spaced from each other such that each of the stops 54 is adjacent to one of the first 46 and second 48 side edges. The stops 54 are abuttable against an outer surface of a side wall 58 of the drywall mud applicator 13 to stabilize the wall 22 with respect to the drywall mud applicator 13.

In use, the drywall mud applicator 12, 13 is used in a conventional manner to cover joints, fasteners and marks in the drywall. When the user stops using the drywall mud applicator 12, 13 the closure assembly 20 is used to cover the access opening 14, which may be used for filling or dispensing mud, to prevent the mud within the drywall mud applicator 12, 13 from drying out. When work is resumed the closure assembly 30 is removed from the drywall mud applicator 12, 13. It should be understood that not all of the drywall mudding assist devices are shown which may benefit from the closure assemblies 20 shown herein. The version shown in FIG. 1 may be used, in various sizes, for use on angle boxes, goosenecks, pumps, automatic taping tools, needle valves and the like which may easily become clogged and unusable when the mud material therein dries out.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drywall mud applicator access opening closure system, said system including:

a drywall mud applicator having an access opening therein, said access opening defining a fill aperture being configured for receiving mud for usage by said drywall mud applicator; and a closure assembly being removably positioned over said access opening and closing said access opening to inhibit air from entering said access opening, said closure assembly comprising:

a wall having a front side, a back side and a perimeter edge, said front side being planar; and an aperture cover being attached to and extending away from said front side, said aperture cover having a size and shape configured to cover said access opening to prevent air from entering the access opening, said aperture cover having a tubular shape having a proximal end attached to said wall and a distal end spaced from said wall, said distal end having a well extending therein configured for receiving a conduit fluidly coupled to the access opening;

said perimeter edge extending outwardly away from said aperture cover to define a flange between said aperture cover and said perimeter edge to facilitate gripping of said wall, said front side of said flange being continuously planar from said perimeter edge to said aperture cover, said perimeter edge being defined as a juncture of said front side and said back side, said perimeter edge being spaced from said drywall mud applicator when said distal edge of said aperture cover is adjacent to said drywall mud applicator to define a gripping space between said drywall mud applicator and said flange.

2. The system according to claim 1, wherein said perimeter edge extends away from said flange in all directions with respect to said aperture cover.

3. The system according to claim 1, wherein said aperture cover has a cylindrical shape.

4. The system according to claim 1, wherein said aperture cover has a frustum shape and narrowing from said wall to said distal end, said aperture cover having a base abutting said wall having a length dimension and a width dimension wherein said length dimension is greater than said width dimension.

5. The system according to claim 1, wherein said aperture cover has a frustom shape and narrowing from said wall to said distal end, said aperture cover having a base abutting said wall having a length dimension and a width dimension wherein said length dimension is greater than said width dimension.

* * * * *